United States Patent [19]

Sigmund

[11] 4,104,779

[45] Aug. 8, 1978

[54] TIGHTENING METHOD AND SYSTEM

[75] Inventor: Jerry A. Sigmund, Willow Grove, Pa.

[73] Assignee: SPS Technologies, Inc., Jenkintown, Pa.

[21] Appl. No.: 755,408

[22] Filed: Dec. 29, 1976

[51] Int. Cl.[2] ..... B25B 23/14

[52] U.S. Cl. ..... 29/407; 73/88 F; 173/12

[58] Field of Search ..... 73/88 F, 139; 173/1, 173/12; 81/52.4 R, 52.4 B, 52.5; 29/240, 407

[56] References Cited

U.S. PATENT DOCUMENTS

| | | | |
|---|---|---|---|
| 3,982,419 | 9/1976 | Boys | 73/139 |
| 4,023,406 | 5/1977 | Benz, Jr. | 73/88 F X |
| 4,027,530 | 6/1977 | Tambini et al. | 73/88 F |

*Primary Examiner*—Charles A. Ruehl
*Attorney, Agent, or Firm*—Aaron Nerenberg

[57] ABSTRACT

A preferred embodiment of the invention disclosed herein relates to a method of and tightening system for tightening a joint assembly including a fastener system to a yield point of one of the members in the assembly. According to the method, torque is applied and rotation is imparted to a fastener member, and the torque and rotational displacement of the fastener are determined at predetermined increments of rotation for use in determining the area between successive increments of rotation under the Torque-Rotation curve which could be plotted. The incremental areas are compared to determine when some member in the joint assembly has been tightened to its yield point or some similarly significant point. The tightening system includes a wrench and a control system associated with the wrench including measuring systems for developing a first signal representative of the torque applied to the fastener and a second signal representative of the rotation of the fastener. Both the first and second signals are fed to an incremental area calculating system included in the control system, which calculates and develops a signal representative of the area under the Torque-Rotation curve which could be plotted for the fastener being tightened, between successive predetermined increments of rotation. The control system further includes decision making means responsive to the incremental area signals for developing a control signal when some member in the joint assembly has been tightened to its yield point or some similarly significant point.

19 Claims, 4 Drawing Figures

TIGHTENING METHOD AND SYSTEM

This invention relates generally to a method and apparatus of the type disclosed in the following U.S. Pat. Nos. owned by the Assignee of this invention: Hardiman et al, No. 3,939,920; Aspers et al, No. 3,965,778; Smith, No. 3,973,434; Walker, No. 3,974,685; Sigmund, No. 3,974,883 and Boys, No. 3,982,419.

In the design of structural joints secured by mechanical fastener systems, it is usual to provide for the fasteners to exert a predetermined clamping force or load on the structural members to insure the integrity of the joint. When the joints are assembled, therefore, it is desirable that the fasteners be tightened to exert a predetermined axial load on the associated structural members. However, most prior art tightening techniques for tightening threaded fasteners such as nuts and bolts to exert a predetermined load on associated structural members are not entirely satisfactory. For example, the most accurate tightening technique involves a measurement of the axial strain or stretch of the bolt while it is being tightened and relating the stretch to the stress or axial load acting on the bolt through previously calculated stress-strain relationships. While most accurate, practical applications do not usually permit measurement of the stretch of the bolt and, in those instances where the stretch can be measured, it is a time consuming and relatively expensive technique. Accordingly, this technique is used in relatively few applications outside of laboratory testing.

Another known tightening technique and that most commonly used in most joint assembly operations involves the use of torque controlled tools, that is, tools that indicate when the torque applied to the fastener equals or exceeds a predetermined torque and stop tightening the fastener in response thereto. Torque measurement is relatively easy and since torque is related to the axial force induced in the fastener, and exerted on the structural members, the predetermined torque can be selected to theoretically correspond to the predetermined clamp load specified for the joint. However, when tightening threaded fasteners in assembly line operations, wide variations in the actual torque-load relationships are experienced. These variations are caused by a variety of factors including allowable tolerance variations in the dimensions and strength of the fasteners and structural members and lubrication or absence thereof on the mating surfaces of the fasteners and/or the structural members, all of which, in turn, cause large variations in the coefficient of friction between the mating surfaces of the joint. In actual practice, variations of up to ± 30% in the axial load on the bolts used for a particular application can be experienced at the same torque level. Accordingly, the torque control technique is not very accurate.

In an effort to overcome the above-noted problems, several techniques have been attempted that include the use of tools measuring both the torque and angular displacement or rotation of a fastener during the tightening cycle and which include control systems operative in response to these measurements to determine when the slope of a Torque-Rotation curve for the fastener indicates that the yield point of the fastener has been reached and to then stop tightening the fastener. Examples of techniques and tools of this type are disclosed in U.S. Pat. No. 3,643,501, issued Feb. 22, 1972 to Pauley and U.S. Pat. No. 3,693,726, issued Sept. 26, 1972 to Hornig et al. Neither the techniques nor the tools disclosed in the Pauley and Hornig et al patents are generally satisfactory. In each of the disclosed techniques it is necessary to know the torque-rotation relationship for the particular fastener being tightened prior to its tightening. The torque-rotation relationship varies over a wide range for the same reasons that the torque-load relationships vary and, accordingly, the techniques and tools disclosed in the Pauley and Hornig et al patents can be utilized only where the characteristics of the joint assembly are known beforehand and average relationships must be predetermined and utilized in operation of the tools. Accordingly, the versatility and accuracy of the techniques and tools disclosed in the Pauley and Hornig et al patents are not particularly satisfactory.

It is an object of this invention, therefore, to provide a method and apparatus for tightening a fastener system to its yield point or similarly significant point corresponding to a predetermined axial load.

It is yet another object of this invention to provide a method and apparatus for tightening a fastener system to its yield point or similarly significant point indicated by a significant change in the increase in incremental area under the Torque-Rotation curve which could be plotted for the fastener being tightened.

It is still another object of this invention to provide a method and apparatus for tightening a fastener system to a predetermined axial load with minimum previous knowledge of the particular joint being assembled.

Finally, it is an object of this invention to provide a tightening system that is versatile, reliable and accurate.

These and other objects of this invention are accomplished by applying torque and imparting rotation to a fastener member in a joint assembly and measuring a first tightening characteristic, preferably torque, and a second tightening characteristic, preferably rotation, during the tightening process. The area between predetermined increments of the second tightening characteristic under the curve which could be plotted for the first and second tightening characteristics is calculated and the change in the incremental areas is determined. These changes in incremental area are then examined to determine when the yield point has been reached.

More particularly, the determination is made by selecting a change in incremental area to be representative of the change in incremental area in the tightening region of the curve and comparing each instantaneous change in incremental area with the change representative of the change in the tightening region of the curve. Preferably, the change in incremental area selected as representative of the change in the tightening region is the largest change in incremental area experienced up to that instant in the tightening cycle. When the instantaneous change in incremental area is within a range of about 25% to 75% of the representative change, tightening of the fastener member is discontinued.

A system in accordance with this invention for performing the above noted method includes wrench means for tightening a fastener in a joint assembly and has associated therewith a first means for measuring a first tightening characteristic and developing a first signal representative thereof and a second means also associated with the wrench means for measuring a second tightening characteristic and developing a second signal representative thereof. Area calculating means is also provided which is responsive to the first and second signals for calculating the area between predetermined increments of the second tightening characteristic under the curve which could be plotted for the first and second tightening characteristics. The area calculating means develops a signal representative of the incremental area. From the area calculating means the incremental area signal is fed to a first comparator means for determining the change in incremental area signals and for developing difference signals representative of the changes. A decisionmaking means is connected to receive the difference signals from the first comparator means for determining when the yield point has been reached.

More particularly, the system includes means for determining the difference signal representative of the incremental area change in the tightening region of the curve. Preferably the last mentioned means determines the largest difference signal up to any instant in the tightening cycle. The decision-making means includes means for storing the difference signal representative of the incremental area change in the tightening region of the curve and second comparator means for comparing the stored difference signal with the instantaneous difference signal. The second comparator means is arranged to develop a control signal when the instantaneous difference signal is within a range of about 25% to 75% of the stored difference signal and the control signal is operative to discontinue operation of the wrench means.

For a better understanding of the invention disclosed herein, reference is made to the following description of several preferred embodiments taken in conjunction with the figures of the accompanying drawing, in which.

Figure 1:
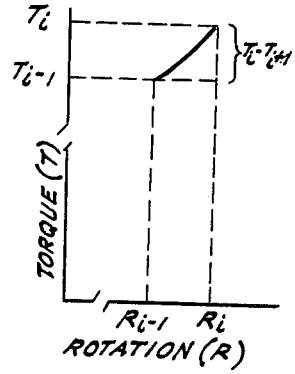
FIG. 1 is a plot of a curve illustrating the characteristics of a typical torque-rotation relationship experienced by a fastener during a tightening cycle and graphically illustrating an underlying principle of the invention.

Referring to FIG. 1, there is illustrated a typical Torque-Rotation curve for a threaded fastener being tightened with the torque plotted along the vertical axis and with the angular displacement or rotation plotted along the horizontal axis. The curve includes an initial or pretightening region extending from the intersection of the torque and rotation axes to point A. In the pretightening region, mating threads of the fastener assembly have been engaged and one of the fasteners is being rotated, but the bearing face of the rotating fastener has not contacted the adjacent face of the structural member included in the joint. At point A on the curve the structural members have been pulled together with the fastener assembly and actual tightening of the joint commences. The torque at point A is commonly referred to as the "snug" torque. In the tightening region of the curve, extending from point A to point B, axial force is exerted by the fastener assembly clamping the joint members together. In the tightening region a typical curve may be slightly arcuate, but approximates linearity. As will be explained hereinafter, a point A' is selected which lies on the tightening region of the Torque-Rotation curve and is called a "turn-on" point in the tightening cycle. Point B is the limit of proportionality of the joint assembly and beyond point B the rotation of the fastener member starts increasing at a significantly faster rate than does the torque. For purposes of this application, point B will be considered as the start of the yield region, but it will be understood that beyond point B, additional axial load is still induced in the joint assembly but at a significantly non-linear rate of increase. Point C corresponds to the yield point of the joint assembly and while the definition of yield point varies slightly, it can be considered to be the point beyond which strain or stretch of the bolt is no longer purely elastic. As will become apparent, a tightening system in accordance with this invention is capable of detecting point C on the Torque-Rotation curve and responding thereto to generate a control signal.

While in the preceding paragraph reference has been made to the limit of proportionality and yield point of the joint assembly, it should be noted that because of the usual design criteria these terms usually apply to characteristics of the fastener assembly since fastener assemblies are not usually as rigid as the structural members forming the joint assembly and most usually apply to the male fastener member or bolt.

It should be understood that the invention relates to a method and apparatus which detects the yield point by utilizing torque and rotation input characteristics but which is also capable of detecting the yield point by utilizing other tightening characteristics related in a manner similar to torque and rotation. It should be further understood that particular joint assemblies could include fastener assemblies constructed such as to cause the curve being plotted to significantly deviate from linearity at a predetermined load other than the yield point. Such deviation could be detected in accordance with this invention and for this reason, as used hereinafter, the term yield point should be construed to include the yield point of the material from which the fastener is made as well as points on a flattened portion of a Torque-Rotation or similar curve generated by the configuration of the fastener at a predetermined clamping load.

Still referring to FIG. 1 there is shown a series of dotted lines extending upwardly from the rotation axis to the Torque-Rotation curve. The dotted lines are located at equally spaced increments of rotation along the axis and of course, of the fastener. Accordingly, between each of the dotted lines is defined an incremental area under the Torque-Rotation curve, that is, an area over a predetermined equal interval of rotation. It can be seen that the incremental areas increase with rotation of the fastener.

As an underlying principle of this invention, it has been determined that at equal intervals of rotation, the change in incremental area in the tightening region, that is, from point A to point B on the curve, varies slightly, but that beyond the limit of proportionality, point B, the change is significant. At yield point C, the change in incremental area lies within a range of about 25% to 75% of the change in incremental area in the tightening region of the curve. Thus, by calculating the incremental areas under the curve between equally spaced increments of rotation, by then determining the change in incremental area, and by comparing the instantaneous change with the change in the tightening region of the curve, the yield point can be determined.

Accordingly, in practicing the method in accordance with this invention, torque is applied to a fastener in a joint assembly thereby imparting rotation to the fastener to tighten it and the joint assembly. Simultaneous with the application of torque and the rotation of the fastener, the torque applied to the fastener and the rotation of the fastener are measured at equally spaced increments of rotation. Utilizing these input characteristics, the incremental area under the curve between equally spaced increments of rotation can be calculated. After calculating the incremental areas, successive areas are subtracted to determine the change in incremental areas between successive intervals of rotation.

As noted previously, the tightening region of the curve, that is, point A to point B may not be exactly linear, but may be slightly arcuate and may also include spikes caused by temporary seizing of the mating threads of the fastener system or by lack of or excessive lubrication between the mating threads at a particular point thereon. Thus, the change in incremental area in the tightening region which would be constant if the Torque-Rotation curve were exactly linear in the tightening region, experiences certain changes in magnitude. For this reason, the largest incremental change in area is designated as the incremental change in area in the tightening region of the curve. Other incremental changes in the area, for example, the smallest incremental change or a moving average of the incremental change can be utilized, but the utilization of the largest change in incremental area is preferred.

In practicing the method in accordance with the preferred embodiment of the invention, therefore, it is usual to compare the instantaneous incremental change in area with the largest incremental change in area realized up to that instant in the tightening cycle. That is, each time the comparison indicates that a larger incremental change in area has been experienced, that larger change is stored for future comparisons with the instantaneous incremental changes in area. When the instantaneous incremental change in area lies within the range of about 25% to 75% of the stored largest incremental change in area, it will be realized that the yield point of the fastener member has been detected and the tightening of the fastener member is discontinued. At this point, the fastener member has been tightened to its yield point. It is noted that it is preferable to tighten the fastener member until the instantaneous incremental change in area is equal to or less than about 50% of the largest incremental change in area experienced in the tightening cycle.

While it should be understood that the area under the curve can be calculated in any of a variety of ways, two particular methods will now be explained. In accordance with one method of calculating the area, a polynominal curve fitting technique can be practiced. By the application of mathematical regression analysis techniques with the torque and rotation data at equally spaced predetermined increments of rotation, a polynomial equation closely approximating the actual equation of the Torque-Rotation curve experienced by the fastener member at that instant can be determined. Mathematical regression analysis techniques are well known and a detailed description in this application is not required.

Once the equation of the curve at each increment of rotation has been determined, the equation can be mathematically integrated between upper and lower limits defined by the total rotation of the fastener at the instantaneous increment of rotation and the total rotation of the fastener at the preceding increment of rotation. The result of the integration is the incremental area under the curve, that is, between successive increments of rotation.

Figure 2:
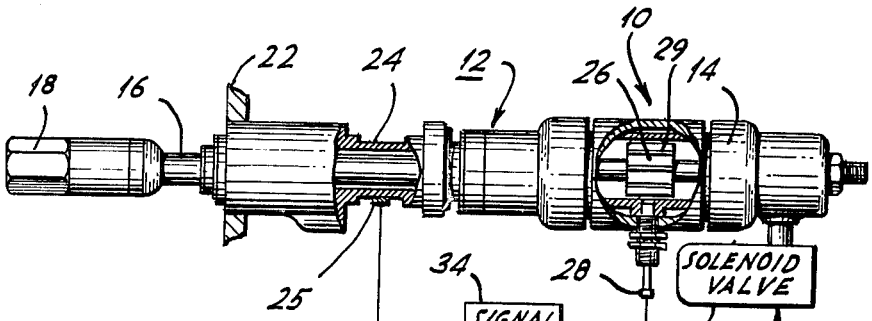
FIG. 2 is an enlarged view of a portion of the curve illustrated in FIG. 1.

In accordance with another technique for determining the area under the curve, the increments of rotation can be considered to be a geometric configuration including a rectangle and a triangle as illustrated in FIG. 2 of the drawing. The width of the rectangle is defined by the interval between successive increments $R_i$ and $R_{i-1}$ of rotation and the length of the torque $T_{i-1}$ applied at the prior increment $R_{i-1}$ of rotation. The base of the triangle is defined by the interval between successive increments $R_i - R_{i-1}$ of rotation and the altitude is defined by the difference $T_i - T_{i-1}$ in the torque applied at each increment of rotation, that is, the torque applied at the instantaneous increment of rotation minus the torque applied at the increment of rotation just prior to the instantaneous increment. The hypotenuse of the right triangle thus defined is slightly arcuate because of the deviation from linearity of the Torque-Rotation curve. While the deviation introduces an error, it is noted that by making the interval between increments of rotation sufficiently small the straight line assumed for the hypotenuse of the right triangle closely approximates the slight curvature of the actual curve.

The incremental area under the curve can be calculated in accordance with this technique by multiplying the length times the width of the rectangle and by multiplying the base by the altitude of the triangle and dividing this product in half. Thereafter, the area of the rectangle and the area of the triangle are added together to provide a close approximation of the incremental area under the curve.

At this point it is noted that in practicing the method in accordance with this invention, no area calculations are made in the tightening cycle until the turn-on point A′ is reached. This is accomplished by comparing the instantaneous torque with a predetermined torque sufficiently large to assure that the fastener is in the tightening region. The predetermined torque and, thus, point A′ can be arbitrarily selected, for example, can be selected to be about 30% of the torque which is expected to be applied to the fastener member at the yield point will suffice.

While the above method may be practiced by utilizing a conventional torque wrench and any conventional angular displacement measuring device currently available, in accordance with another aspect of this invention, a tightening system for carrying out the method is disclosed.

Figure 3:
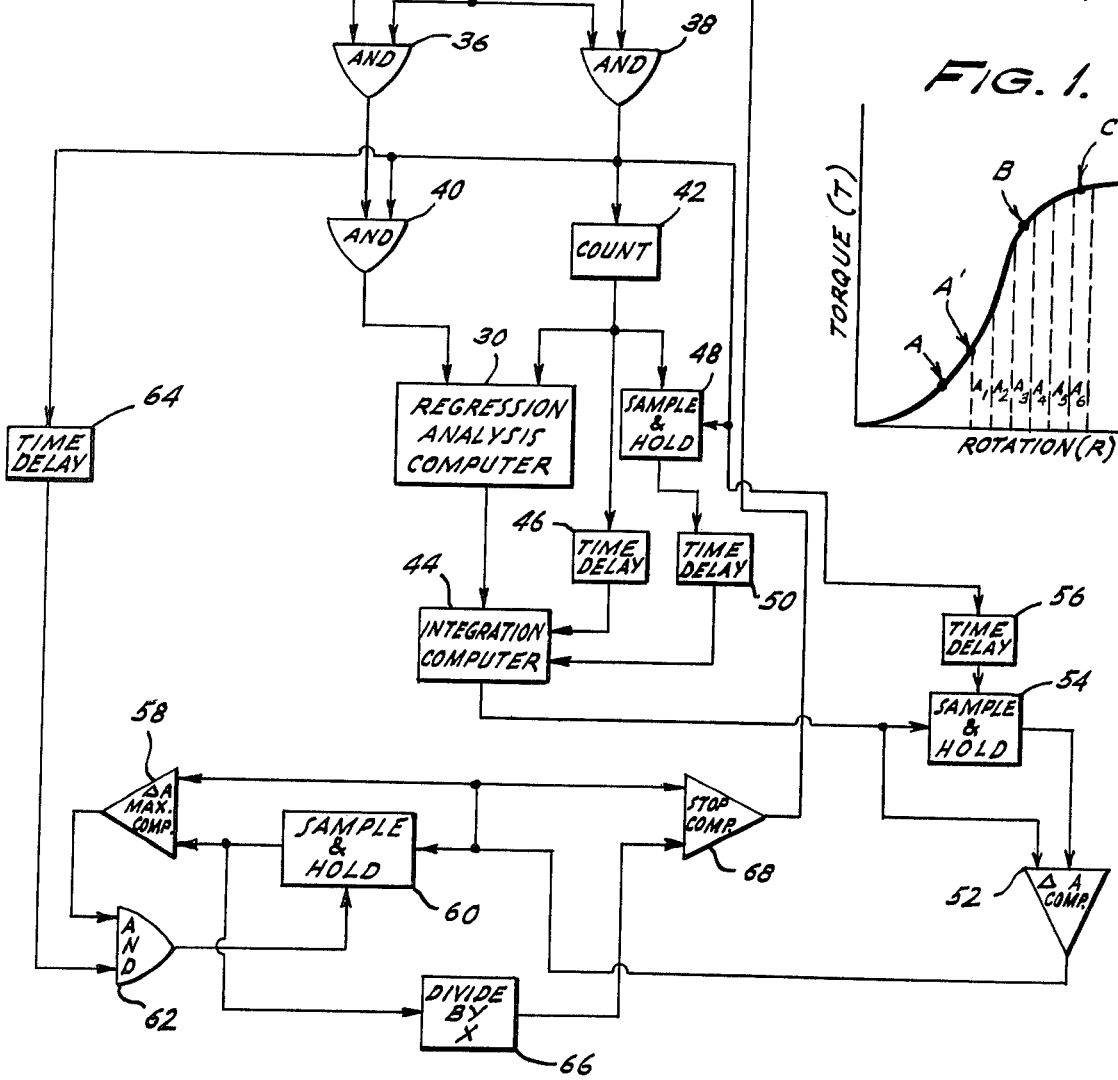
FIG. 3 is a schematic drawing of a tightening system in accordance with one embodiment of the invention; and, FIG. 4 is a schematic drawing of a tightening system in accordance with another embodiment of the invention.

Referring now to FIG. 3, there is illustrated a first embodiment of a tightening system 10 in accordance with this invention. Tightening system 10 includes a wrench 12 having a motor 14, an output drive shaft 16 and driver bit 18. Drive shaft 16 is driven by motor 14 to apply torque and impart rotation to a fastener member engaged by driver bit 18. Wrench 12 can be of any conventional type and as is most common, motor 14 can be air powered with the flow of motive air being controlled by a suitable electrically operated control valve 20. It should be understood that motor 14 could also be electric, hydraulic or any combination of pneumatic, hydraulic or electric. The exact details of the wrench are not necessary for a proper understanding of the invention and, accordingly, a more specific description is not provided.

Mounted between the housing of motor 14 and a rigid frame 22 on which the wrench is carried, is a suitable transducer or torque cell 24 for generating a continuous signal representative of the instantaneous torque being applied to the fastener. Torque cell 24 can be any of a variety of conventional devices and in the embodiment disclosed herein comprises a somewhat flexible annular member having strain gauges 25 secured to its outer periphery so that the reaction torque on the wrench is measured and an electrical signal is generated. The reaction torque is, of course, equal to and opposite the torque being applied to the fastener. Mounted on drive shaft 16 for rotation therewith and preferably within motor 14, is a suitable encoder 26 that cooperates with a proximity detector 28 for developing signals representative of the incremental angular displacement or rotation of the fastener. Encoder 26 is arranged to rotate with the driver bit 18 and can be any of the variety of suitable devices. In this embodiment encoder 26 includes a series of teeth 29 formed on its outer periphery. Proximity detector 28 can be an induction coil which develops an electrical signal when metal passes through its magnetic field and, thus, senses the passage of the encoder teeth and develops an electrical signal representative of predetermined increments of angular rotation. While examples of torque and rotation measuring devices have been described, it should be understood that any of a variety of devices for accomplishing the noted result can be utilized with the invention.

Associated with the wrench 12 is a control circuit capable of performing the method described above utilizing the polynomial curve fitting technique involving mathematical regression analysis. To this end, the control circuit includes a regression analysis computer 30 into which the torque and rotation signals are fed to develop an equation for the Torque-Rotation curve up to any instant in the tightening cycle. The regression analysis computer 30 can be any of a variety of devices including a combination of an electronic data processing computer and a computer program for performing the mathematical regression analysis. As an example, a programmable calculator currently manufactured by Tektronix, Inc. of Beaverton, Oregon and sold as the TEK Model 31 is a calculator capable of performing regression analysis techniques and can be suitably modified to accept the torque and rotation inputs from the transducer 24 and the proximity probe 28 instead of the hand-fed inputs associated with that apparatus.

At this point it is noted that the torque cell 24 and proximity detector 28 provide no inputs to the regression analysis computer 30 until the turn-on point A′, illustrated in FIG. 1 of the drawing, has been reached in the tightening cycle. That is, the regression analysis computer 30 receives no inputs until the fastener has been tightened to a point located in the tightening region of the Torque-Rotation curve. To accomplish this, a comparator 32 receives the torque signal from the strain gauge 25 and compares the instantaneous torque with a signal discharged from a generally conventional signal generating device 34 which signal is representative of a predetermined torque value presumed, from a previous determination, to be in the tightening region of the curve. For example, a torque value equal to about 30% of the torque normally expected at the yield point of the fastener being tightened will suffice. When the comparator 32 determines that the instantaneous torque signal exceeds the predetermined torque signal from the signal generator 34, it outputs an enabling signal to a pair of AND gates 36 and 38, the former also receiving the torque signal from strain gauge 25 and the latter receiving signals from the proximity detector 28 at predetermined increments of rotation. When the turn-on point A′ has been reached in the tightening cycle, and the AND gate 36 receives a signal from comparator 32, the instantaneous torque signal is fed to another AND gate 40 which also receives signals from the AND gate 38. Accordingly, after the predetermined turn-on torque has been detected by comparator 32, at each increment of rotation of the fastener, AND gate 40 feeds to the regression analysis computer 30 a signal representative of the instantaneous torque at that increment of rotation. In addition, the AND gate 38 outputs the signal representative of an increment of rotation to a conventional counter 42 which adds the signals to provide a signal representative of the total rotational displacement of the fastener and feeds that signal to the regression analysis computer. Thus, it can be seen that at each increment of rotation a signal is fed to the regression analysis computer 30 representative of the torque on the fastener at that increment and also a signal representative of the total rotational displacement of the fastener at that increment.

The regression analysis computer 30 stores and uses all of the torque and rotation signals received to compute the equation for the Torque-Rotation curve at the instantaneous increment of rotation. From the regression analysis computer 30 signals representative of the equation of the Torque-Rotation curve at that increment of rotation are fed to an integration computer 44. The integration computer 44 can also be any generally conventional device capable of performing mathematical integration of the equation which it receives at its input. Such computers are a combination of a programmable calculator and a computer program which are generally well-known in the art and need not be described here. As an example, however, the Tektronix TEK Model 31 can perform such integrations. In addition to the equation from the regression analysis computer 30, the integration computer 44 receives input signals representative of the upper and lower limits over which the integration should be calculated to provide the incremental area under the curve between those limits. Accomplishing this, the upper limit is provided by feeding the total rotational displacement signal at the instantaneous increment of rotation from the counter 42 to the integration computer 44 through a time-delay circuit 46 of any conventional type; the lower limit is provided by feeding a signal representative of the total rotational displacement of the fastener at the previous increment of rotation from a shift register 48 in the form of a sample and hold circuit comprising a charge coupled device. Between the shift register 48 and the integration computer 44 is a time-delay circuit 50 providing a delay in feeding the signal from the shift register to the computer which delay is equal to that provided by time-delay circuit 46.

The shift register 48 is a one bit register receiving a signal representative of the total rotational displacement of the fastener and storing that signal until it is clocked by an enabling signal from the AND gate 38. When the shift register 48 is clocked by the signal representative of the instantaneous increment of rotation, it outputs a signal representative of the total rotational displacement of the fastener at the previous increment of rotation. Thus, the lower limit for the integration is the instantaneous total rotational displacement at the previous increment of rotation. Use of the time-delay circuits 46 and 50 assure that the regression analysis computer 30 and integration computer 44 have completed their calculations before the integration limit signals are fed to the integration computer. From the integration computer 44 a signal representative of the incremental area under the curve is fed to means for determining the change in incremental area between successive increments of rotation. Accordingly, the signal from the integration computer 44 is split and fed to a comparator 52 for determining the difference in incremental area. The signal from the integration computer 44 is also fed to a shift register 54 in the form of a sample and hold circuit including a charge coupled device. The shift register 54 is a one bit register which stores the signal from the integration computer 44 for one increment of rotation at which time it is clocked by an enabling signal from the AND gate 38 which is fed through a time-delay circuit 56 providing a sufficient time lag so that the sample and hold circuit 54 does not discharge its signal until the integration computer has completed its calculation. Thus, the differential area comparator 52 receives an input signal representative of the incremental area under the curve calculated at the instantaneous increment of rotation and also a signal representative of the incremental area under the curve calculated at the immediately preceding increment of rotation. The output from the differential area comparator 52 is, thus, a difference signal representative of the change in incremental area between successive intervals of rotation.

From the differential area comparator 52, the instantaneous difference signal is fed to decision making means including means for determining the largest change in incremental area and developing a maximum difference signal representative thereof and also means for comparing the maximum and the instantaneous difference signals. Looking first at the means for determining the largest change in incremental area, there is included a maximum incremental area change comparator 58 receiving input signals from the differential area comparator 52 and from a shift register 60 which also receives signals from the differential area comparator 52. The shift register 60 is in the form of a sample and hold circuit including a charge coupled device. As will be made clear hereinafter, shift register 60 stores a maximum difference signal representative of the largest change in incremental area encountered up to the increment of rotation prior to the instantaneous increment and outputs that signal to the comparator 58. Thus, comparator 58 determines whether the instantaneous difference signal or the previously stored maximum difference signal is larger. If the instantaneous difference signal is larger, comparator 58 feeds an output signal to an AND gate 62 which also receives a signal from AND gate 38 through a time-delay circuit 64. When both signals are received by AND gate 62, it outputs an enabling signal to shift register 60 which allows the shift register to receive a new difference signal from differential area comparator 52 which is representative of the larger change in incremental area. If the instantaneous difference signal is smaller, comparator 58 provides no output, nor does AND gate 62 so that shift register 60 cannot accept the instantaneous difference signal. By utilizing the clocking signal from AND gate 38 and time-delay 64, a time lag is provided which allows the comparison to be made before a clocking signal can be fed through AND gate 62 and, thus, before a new instantaneous difference signal can be developed.

Looking now at the means for comparing the maximum and instantaneous difference signals, it can be seen that as the maximum difference signal is fed from shift register 60 to comparator 58, it is split and fed to a division circuit 66 which is operative to divide the signal by the preset relationship utilized to determine the yield point, shown at C on the Torque-Rotation curve illustrated in FIG. 1, for the particular fastener being tightened. If the preset relationship is 50%, as is preferred, the division circuit 66 splits the largest difference signal in half and feeds the split signal to a stop comparator 68 so that it may be compared with an instantaneous difference signal from the differential area comparator 52, which signal is also fed to the stop comparator. When the input signals to the control comparator 68 are equal, or when the instantaneous difference is less than the split maximum difference signal, the stop comparator provides a control signal which is fed to the solenoid valve 20, closing the valve and stopping the motor 14. When the motor 14 stops, of course, tightening of the fastener is discontinued.

At this point it is noted that the equation of the curve determined at each increment of rotation may vary slightly from the equation determined at previous increments of rotation. However, any variations should not be significant and an incremental area calculated under a previously determined Torque-Rotation curve should not vary significantly from the incremental area at the same increment of rotation for a subsequently determined Torque-Rotation curve. If desired, however, the integration computer can be arranged to calculate all the incremental areas each time it receives a new equation for the Torque-Rotation curve and to feed area signals to a comparison circuit to determine the changes in successive incremental area. From the noted comparison circuit difference signals representative of the changes in incremental areas can be fed to another comparison circuit which determines the largest change in incremental area under the curve defined by the new equation and can discharge this largest difference signal to the shift register 60 before the differential area comparator 52 feeds the instantaneous difference signal to the shift register.

Figure 4:
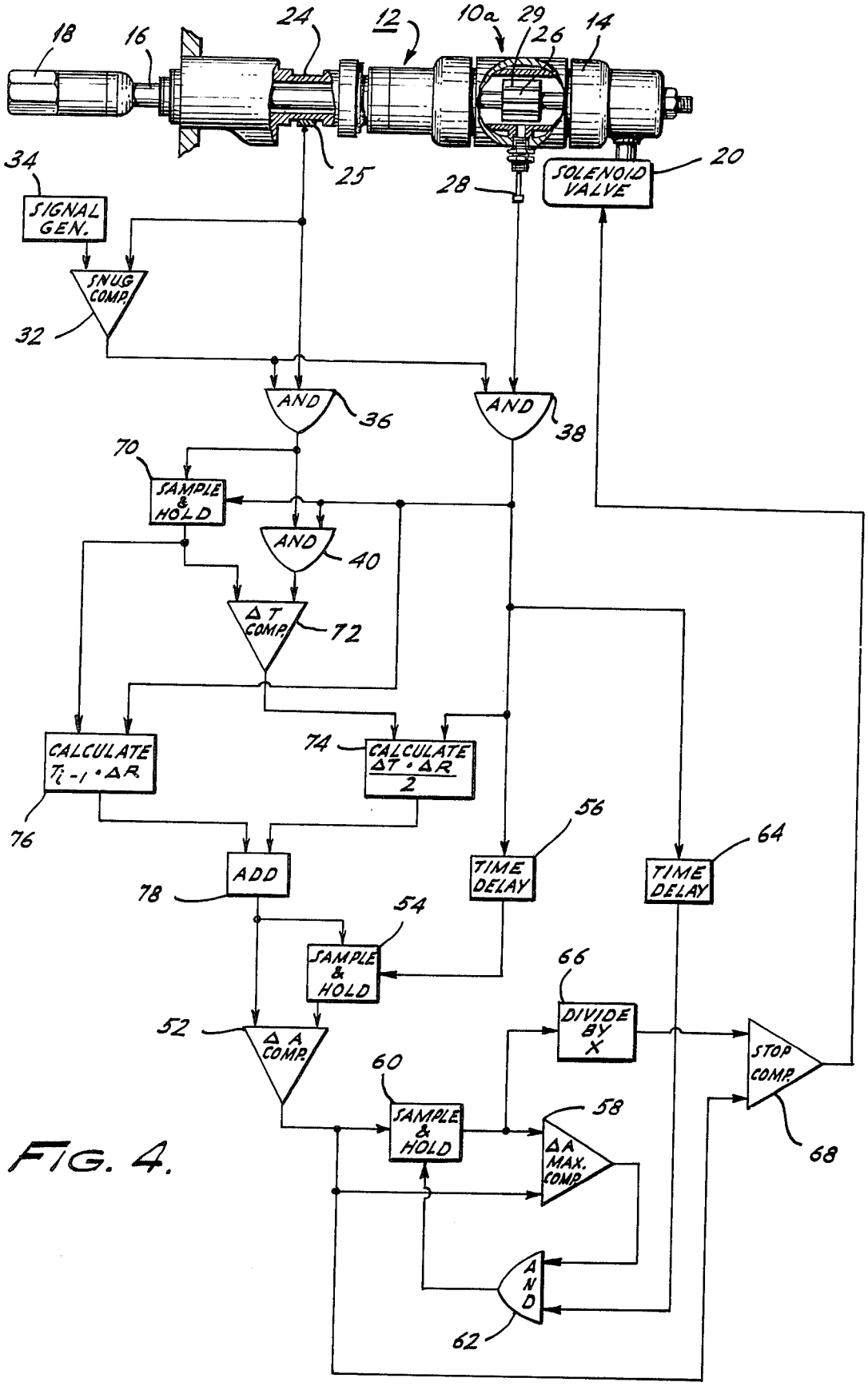

Referring now to FIG. 4 of the drawing, another embodiment of apparatus in accordance with this invention is illustrated and operates to calculate the area between the increments of rotation in accordance with the second such technique previously explained, that is, operates to calculate the area of the rectangular and triangular portions at each interval of rotation under the Torque-Rotation curve. It can be seen that various components in the system **10*a* illustrated in FIG. 4 are generally similar to components illustrated in FIG. 3 and, accordingly, like reference numerals are utilized. For example, the wrench 12 includes a motor 14, output drive shaft 16 and driver bit 18. A suitable electrically operated solenoid control valve 20 is also provided as is the rigid frame 22 on which the wrench 12 is carried. Also provided is the transducer or torque cell 24 including strain gauges 25 for developing a continuous signal representative of the torque being applied to the fastener. Finally, there is also included a suitable encoder 26 and proximity probe 28** for developing signals at predetermined increments of rotation.

Also included is the comparator 32 and the signal generator 34 which function as described with respect to the embodiment illustrated in FIG. 3. That is, the comparator 32 provides for a comparison of the instantaneous torque being applied to the fastener against a reference torque signal from signal generator 34 and provides an output when the turn-on point A' has been reached in the tightening cycle. The output from the snug torque comparator 32 is fed to AND gates 36 and 38. When the enabling signal from snug torque comparator 32 is received by AND gate 36, the torque signal from the strain gauge 25, which is also fed to AND gate 36, is fed to a shift register 70 in the form of a sample and hold circuit including a charge coupled device, the torque signal is also fed to a differential torque comparator 72 through another AND gate 40. The shift register 70 is a one bit register which provides an output to the differential torque comparator 72 when it is clocked by a signal from AND gate 38. As should be clear the AND gate 38 provides an output after the turn-on point A' in the tightening cycle at each increment of rotation so that at each increment of rotation the comparator 72 receives a signal representative of the torque applied to the fastener at the previous increment of rotation. When the AND gate 40 receives an output signal from the AND gate 38 the instantaneous torque applied to the fastener is also fed to the differential comparator 72. Accordingly, the output from the comparator 72 is a signal representative of the difference between the instantaneous torque and the torque at the previous increment of rotation and, referring briefly to FIG. 2 of the drawing, can be seen to be representative of the altitude, $T_i - T_{i-i}$ of, the right triangle illustrated therein. The differential torque signal from comparator 72 is discharged to a calculator circuit 74 which also receives an input from AND gate 38 which conveniently can be set to be representative of the base, $R_i - R_{1-1}$, of the right triangle illustrated in FIG. 2 of the drawing. The calculator circuit 74 includes a suitable multiplication circuit for multiplying the differential torque and incremental rotation signals and also includes a divider circuit for dividing that product in half so that its output is a signal representative of the area of the triangle portion of the incremental area.

There is also provided an additional calculator circuit 76 which receives a signal from the shift register 70 when that register is clocked by a signal from AND gate 38. Accordingly, one input to the calculator circuit 76 is a signal representative of the torque at the previous increment of rotation, that is, the height of the rectangle illustrated in FIG. 2 of the drawing. In addition, the calculator circuit 76 also receives a signal from AND gate 38 which as noted previously is representative of the interval of rotation of the fastener member, that is, the width $R_i$-$R_{i-1}$, of the rectangle illustrated in FIG. 2 of the drawing. Accordingly, the calculator circuit which is in the form of a multiplier circuit provides an output signal representative of the area of the rectangular portion of the incremental area. The signals from calculators 74 and 76 are fed to an adder circuit 78 which adds the signals and provides an output representative of the incremental area under the curve.

From the adder circuit 78 the incremental area signal is processed in the same manner as the signal output from integration computer 44 disclosed in the embodiment of the invention illustrated in FIG. 3 of the drawing. To summarize that processing, the signal from the adder circuit 78 is fed to a differential area comparator 52 and a shift register 54. The shift register 54 is clocked by the output of the AND gate 38 through a suitable time-delay circuit 56 which enables the area calculations noted above to be performed and which then discharges the stored signal to the differential area comparator 52. Accordingly, the signal from the shift register 54 is representative of the area calculated at the previous increment of rotation. The differential area comparator 52 thus outputs a difference signal representative of the change in incremental area under the Torque-Rotation curve.

From the differential area comparator 52, the difference signal representative of the instantaneous incremental change in area is fed to the maximum differential area comparator 58 and the shift register 60 which also outputs to the differential area comparator. If the instantaneous difference signal is larger, the comparator 58 feeds an output signal to an AND gate 62 which also receives a signal from AND gate 38 through a time-delay circuit 64. When both signals are received by AND gate 62, it outputs an enabling signal to shift register 60 which allows the shift register to receive a new difference signal from the differential area comparator which is representative of the larger change in incremental area. If the instantaneous difference signal is smaller, the comparator 58 provides no output, nor does AND gate 62 so that the shift register 60 cannot accept the instantaneous difference signal. In addition, the shift register 60 provides an output through a divider circuit 66 arranged to split the signal in accordance with the preset relationship explained previously and to feed that signal to a stop comparator 68. The other input to the stop comparator 68 is the instantaneous difference signal from the comparator 52 and when the comparator 68 detects that instantaneous change in area is equal to or less than the split maximum difference signal, the stop comparator provides an output signal to the solenoid valve 20, closing the valve and stopping the motor.

While in the foregoing there has been disclosed preferred embodiments of the invention, it should be obvious to those skilled in the art that various modifications and changes can be made without departing from the true spirit and scope of the invention as recited in the appended claims.

I claim:

1. A tightening system for tightening an assembly including a fastener system until the yield point or some similarly significant point has been detected, said system comprising:

wrench means for applying tightening characteristics to the fastener;

first means associated with said wrench means for measuring a first tightening characteristic and developing a first signal representative thereof and second means associated with said wrench means for measuring a second tightening characteristic and developing a second signal representative thereof;

area calculating means responsive to said first and second signals for calculating the area between predetermined increments of said second tightening characteristic under the curve of said first tightening characteristic vs. said second tightening characteristic which could be plotted for said tightening characteristics, and for developing a signal representative thereof;

first comparator means for determining the change between successive incremental area signals and developing a difference signal representative thereof; and decision making means responsive to said difference signal for determining when the yield point has been reached and for developing a control signal.

2. A tightening system in accordance with claim 1 wherein said decision making means includes means for determining the difference signal representative of the change in incremental area in the tightening region of the curve, means for storing said representative difference signal and second comparator means for comparing said representative difference signal with an instantaneous difference signal developed at any point on the curve.

3. A tightening system in accordance with claim 2 wherein said means for determining said representative difference signal determines the largest difference signal developed up to that instant on the tightening cycle.

4. A tightening system in accordance with claim 2 wherein said second comparator means develops said control signal when said instantaneous difference signal is within a range of about 25% to 75% of said representative difference signal.

5. A tightening system in accordance with claim 1 wherein said area calculating means includes regression analysis computer means responsive to said first and second signals for determining the equation for the curve of said first tightening characteristic vs. said second tightening characteristic which could be plotted for said tightening characteristics and for developing equation signals representative thereof, said area calculating means further including integration computer means responsive to said equation signals for integrating said signals between limits defined by said predetermined increments of said second tightening characteristic.

6. A tightening system in accordance with claim 1 wherein said area calculating means includes first calculator means for determining the area of a rectangular portion between said predetermined increments of said second tightening characteristics under said curve and developing a signal representative thereof, second calculator means for determining the area of a triangular portion between said predetermined increments of said second tightening characteristics under said curve and developing a signal representative thereof and adder means for adding said rectangular and triangular area signals.

7. A tightening system in accordance with claim 1 wherein said area calculating means includes means for determining the difference in said first tightening characteristic between the instantaneous increment of said second tightening characteristic and the previous increment of said second tightening characteristic and developing a first tightening characteristic difference signal and first calculator means for multiplying said first tightening characteristic difference signal by a signal representative of the difference between said predetermined increments of said second tightening characteristic and for dividing the product by two, second calculator means for multiplying the first signal at said previous increment of said second characteristic by said signal representative of the difference between said predetermined increments of said second tightening characteristic and developing a signal representative of said product and means for adding said first calculator means signal and said second calculator means signal.

8. A tightening system in accordance with claim 7 wherein said signal representative of the difference between increments of said second characteristic is said second signal.

9. A tightening system in accordance with claim 1 wherein said first means is a transducer for measuring the torque being applied to said fastener and wherein said second means is an angular displacement probe for measuring predetermined rotational displacement of said fastener.

10. A tightening system in accordance with claim 1 including means responsive to said control signal for discontinuing the operation of said wrench means.

11. A method for tightening a fastener system in a joint assembly until the yield point or similarly significant point has been detected, said method comprising:

applying tightening characteristics to the fastener;

measuring a first tightening characteristic and a second tightening characteristic during the tightening cycle;

calculating the area between predetermined increments of said second tightening characteristic under the curve of said first tightening characteristic vs. said second tightening characteristic which could be plotted for said tightening characteristics;

determining the change between successive incremental areas; and, examining changes in incremental areas and determining when the yield point has been reached.

12. A method in accordance with claim 11 including the step of determining the change in incremental areas representative of the change in the tightening region of the curve and comparing instantaneous changes with the change representative of the change in the tightening region.

13. A method in accordance with claim 12 wherein the tightening of the fastener is discontinued when the instantaneous change is within a range of about 25% to 75% of the change representative of the change in the tightening region of the curve.

14. A method in accordance with claim 11 including the step of determining the largest change in incremental area under the curve and comparing instantaneous changes with the largest change.

15. A method in accordance with claim 14 wherein the tightening of the fastener is discontinued when the instantaneous change is within a range of about 25% to 75% of the largest change.

16. A method in accordance with claim 11 wherein the area is calculated by simultaneously measuring the first and second tightening characteristics and analyzing said characteristics in accordance with mathematical regression analysis techniques to determine the equation of the curve and thereafter integrating the equation between successive increments of said second tightening characteristic.

17. A method in accordance with claim 11 wherein the area is calculated by dividing the area under the curve into a rectangulr portion and a generally triangular portion, calculating the area of each portion and adding the areas together.

18. A method in accordance with claim 11 wherein the first tightening characteristic is torque and the second tightening characteristic is rotation.

19. A method in accordance with claim 11 wherein the application of tightening characteristics is discontinued when it has been determined that the yield point has been reached.

* * * * *